US010317051B2

(12) United States Patent
Neal et al.

(10) Patent No.: US 10,317,051 B2
(45) Date of Patent: Jun. 11, 2019

(54) LIGHT COVE FOR PERIMETER OF SUSPENDED CEILING

(71) Applicant: Worthington Armstrong Venture, Malvern, PA (US)

(72) Inventors: Joshua L. Neal, Elverson, PA (US); Brett W. Sareyka, Glen Mills, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 15/315,164

(22) PCT Filed: Jun. 6, 2016

(86) PCT No.: PCT/US2016/036027

§ 371 (c)(1),
(2) Date: Nov. 30, 2016

(87) PCT Pub. No.: WO2016/197110

PCT Pub. Date: Dec. 8, 2016

(65) Prior Publication Data

US 2018/0216806 A1 Aug. 2, 2018

Related U.S. Application Data

(60) Provisional application No. 62/171,423, filed on Jun. 5, 2015.

(51) Int. Cl.
*F21V 21/04* (2006.01)

(52) U.S. Cl.
CPC ..... *F21V 21/048* (2013.01); *F21V 21/045* (2013.01); *F21V 21/049* (2013.01)

(58) Field of Classification Search
None
See application file for complete search history.

(56) References Cited

U.S. PATENT DOCUMENTS 5,226,719 A 7/1993 Feldpausch et al.
5,713,657 A * 2/1998 Dearborn ..... A47H 2/00 362/147

(Continued)

FOREIGN PATENT DOCUMENTS

WO 2014189700 11/2014

*Primary Examiner* — Elmito Breval
(74) *Attorney, Agent, or Firm* — Stradley Ronon Stevens & Young, LLP

(57) ABSTRACT

A lighting cove apparatus including a lighting cove and a lighting module. The lighting cove includes a horizontal arm and a first and a second vertical leg attached to opposite ends of the horizontal arm. The first vertical leg and the second vertical leg each include a shoulder on an inside face. The lighting module includes a body and a plurality of retractable latches having downward facing points which retract into the body. When the lighting module is inserted into the lighting cove between the first vertical leg and the second vertical leg, the shoulders on the first vertical leg and the second vertical leg press on the retractable latches such that the retractable latches retract and the lighting module can pass the shoulders. When the lighting module passes the shoulders the retractable latches re-extend and prevent the lighting module from being removed from the lighting cove.

17 Claims, 14 Drawing Sheets

(56) References Cited

U.S. PATENT DOCUMENTS

| | | | | |
|---|---|---|---|---|
| 7,658,518 | B2 * | 2/2010 | Shwisha | F21S 8/033<br>248/227.1 |
| 8,388,214 | B1 | 3/2013 | Toro et al. | |
| 2009/0257219 | A1 * | 10/2009 | Doubek | F21V 17/164<br>362/147 |
| 2011/0267826 | A1 | 11/2011 | Santiago et al. | |
| 2013/0314907 | A1 | 11/2013 | Swisha et al. | |

* cited by examiner

LIGHT COVE FOR PERIMETER OF SUSPENDED CEILING

RELATED APPLICATIONS

This application is a United States national phase application of International Application No. PCT/US2016/036027 filed on Jun. 6, 2016, which claims the benefit of priority to U.S. Provisional Patent Application Ser. No. 62/171,423, filed on Jun. 5, 2015, the contents of which are incorporated in this application by reference.

FIELD OF THE INVENTION

The invention relates generally to a suspended ceiling system. More particularly, the invention relates to a lighting cove at the perimeter of a suspended ceiling system.

BACKGROUND

Some ceiling systems include a grid support system hung from an overhead structure (i.e., a suspended ceiling system) which includes an array of orthogonally intersecting longitudinal grid support members and lateral grid support members arranged in a fairly uniform pattern with regular intervals. The longitudinal grid support members and the lateral grid support members define a plurality of grid openings configured to support individual ceiling panels. Mechanical and electrical utilities (such as wiring, plumbing, etc.) may be conveniently routed in a hidden manner in the cavity or plenum formed above the grid support members and ceiling panels, making suspended ceiling systems a practical and popular ceiling option for residential, commercial, and industrial building spaces.

It is often desirable to create a cove along the perimeter of the suspended ceiling system (i.e., between the suspended ceiling system and an adjacent wall) into which a lighting module may be installed. Traditionally, this detail is completed with studs and drywall materials, and the architect details this part of the building with little planning or thought to how it gets constructed. As a result, ceiling light coves are often needlessly complex and difficult to construct, and therefore very expensive due to this added labor. Accordingly, there is a need for ceiling light coves which offer predictable lighting performance as well as simple and inexpensive installation.

SUMMARY

Embodiments of the invention include a lighting cove apparatus having a lighting cove including a horizontal arm, a first vertical leg attached to a first end of the horizontal arm, and a second vertical leg attached to a second end of the horizontal arm, wherein the first vertical leg and the second vertical leg each include a shoulder on an inside face; and a lighting module including a body and a plurality of retractable latches having downward facing points which retract into the body. When the lighting module is inserted into the lighting cove between the first vertical leg and the second vertical leg, the shoulders on the first vertical leg and the second vertical leg press on the retractable latches such that the retractable latches retract and the lighting module can pass the shoulders. When the lighting module passes the shoulders, the retractable latches re-extend and prevent the lighting module from being removed from the lighting cove.

Embodiments of the invention include another lighting cove apparatus having a lighting cove including a horizontal arm, a first vertical leg attached to a first end of the horizontal arm, and a second vertical leg attached to the horizontal arm, wherein the first vertical leg includes a downward facing hook and a lower protuberance on an outside face of the first vertical leg, the downward facing hook nearer the horizontal arm than the lower protuberance, the lower protuberance including a horizontal prong and a vertical prong; and a wall hook having a upper vertical portion, a lower vertical portion, and an upward facing hook which separates the upper vertical portion and the lower vertical portion. The downward facing hook on the outside face of the first vertical leg of the lighting cove rests on the upward facing hook of the wall hook, and the horizontal prong and the vertical prong are both in contact with an end of the lower vertical portion of the wall hook.

Embodiments of the invention include another lighting cove apparatus having a lighting cove, a wall hook, a lighting module, a hanging clip, and a hang wire. The lighting cove includes a horizontal arm, a first vertical leg attached to a first end of the horizontal arm; a second vertical leg attached to a second end of the horizontal arm; a wall attachment portion on an outside face of the first vertical leg having a downward facing hook and a lower protuberance; a first light attachment portion on an inside face of the first vertical leg having a shoulder; a second light attachment portion on an inside face of the second vertical leg having a shoulder; and a hanger attachment portion on an outside face of the second vertical leg having a downward facing hook and an upward facing hook. The downward facing hook of the wall attachment portion is nearer the horizontal arm than the lower protuberance, and the lower protuberance includes a horizontal prong and a vertical prong. The wall hook includes an upper vertical portion, a lower vertical portion, and an upward facing hook which separates the upper vertical portion and the lower vertical portion. The downward facing hook of the wall attachment portion of the lighting cove rests on the upward facing hook of the wall hook, and the horizontal prong and the vertical prong of the wall attachment portion of the lighting cove are both in contact with an end of the lower vertical portion of the wall hook.

The lighting module includes a body and a plurality of retractable latches having downward facing points which retract into the body. When the lighting module is inserted into the lighting cove between the first vertical leg and the second vertical leg, the shoulders on the first vertical leg and the second vertical leg press on the retractable latches such that the retractable latches retract and the lighting module can pass the shoulders. When the lighting module passes the shoulders the retractable latches re-extend and prevent the lighting module from being removed from the lighting cove.

The hanging clip includes a body and a protrusion attached to the body. The body of the hanging clip has a top edge contacting the downward facing hook of the hanger attachment portion of the lighting cove and a bottom edge contacting the upward facing hook of the hanger attachment portion of the lighting cove. The protrusion of the hanging clip has a hole. The hang wire has a first end inserted through the hole in the protrusion of the hanging clip and a second end secured to a structure

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

When referring to the drawing, like reference numbers refer to like elements throughout the various figures that comprise the drawing.

DETAILED DESCRIPTION

Embodiments of the invention provide for systems and components for securing a light fixture between a wall and a suspended ceiling in a lighting cove. Various terms relating to aspects of the invention are used throughout the specification and claims. Such terms are to be given their ordinary meaning in the art, unless otherwise indicated. Other specifically defined terms are to be construed in a manner consistent with the definition provided herein. As used herein, the singular forms "a," "an," and "the" include plural referents unless expressly stated otherwise. As used herein, terms such as "vertical," "top," "bottom," "upward," "downward" and the like refer to the orientation of the figures. The orientation of the figures is also typically the orientation in which the suspended ceiling is installed. Such directional terms are for illustrative purposes only and should not be interpreted as limiting the invention. Unless otherwise indicated, the various components of the system may be made of any suitable material, for example extruded aluminum.

Figure 1A:
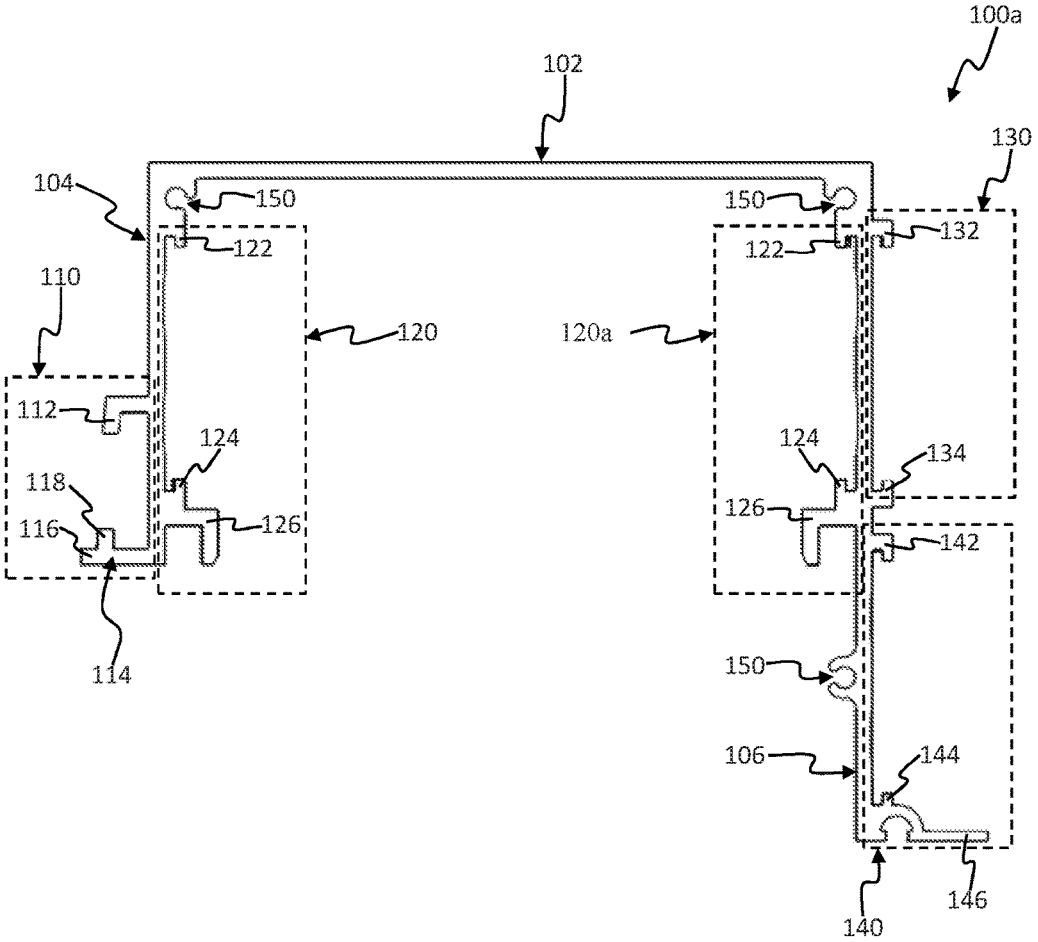
FIG. 1A is a side view of a first lighting cove, according to an embodiment of the invention.
Figure 1B:
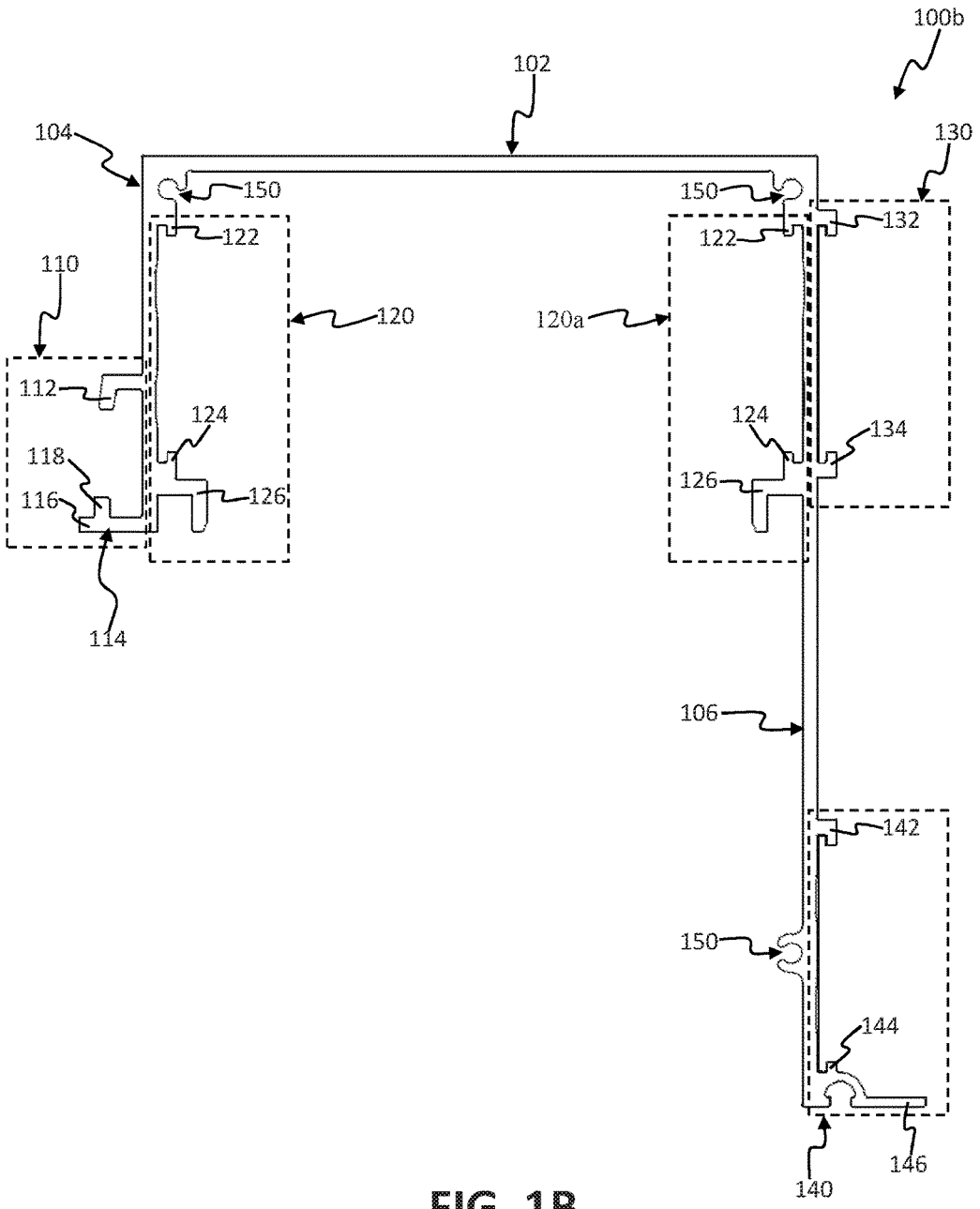
FIG. 1B is a side view of a second lighting cove, according to an embodiment of the invention.

Referring to FIGS. 1A and 1B, exemplary lighting coves 100*a* (FIG. 1A) and 100*b* (FIG. 1B) are provided according to embodiments of the invention. Each lighting cove 100*a* and 100*b* includes a horizontal arm 102 and a first vertical leg 104 and a second vertical leg 106 attached to opposing ends of, and extending down from, the horizontal arm 102. The first vertical leg 104 includes a wall attachment portion 110 on the outside face of the first vertical leg 104 (i.e., the side of the first vertical leg 104 facing away from the second vertical leg 106), and a first light attachment portion 120 on the inside face of the first vertical leg 104 (i.e., the side of the first vertical leg 104 facing toward the second vertical leg 106). The second vertical leg 106 includes a ceiling grid attachment portion 140 on the outside face of the second vertical leg 106 (i.e., the side of the second vertical leg 106 facing away from the first vertical leg 104), and a second light attachment portion 120*a* on the inside face of the second vertical leg 106 (i.e., the side of the second vertical leg 106 facing toward the first vertical leg 104). The second vertical leg 106 may also include a hanger attachment portion 130 on the outside face of the second vertical leg 106 above the ceiling grid attachment portion 140.

The lighting coves 100*a* and 100*b* also include a plurality of screw holes 150 arranged around the lighting coves 100*a* and 100*b*, for example at the intersection of the horizontal arm 102 and the first vertical leg 104, at the intersection of the horizontal arm 102 and the second vertical leg 106, and along the second vertical leg 106. The lighting coves 100*a* and 100*b* differ in the length of the second vertical leg 106. By including a longer second vertical leg 106, the lighting cove 100*b* allows for the ceiling grid attachment portion 140 to be positioned lower with respect to the horizontal arm 102. As a result, a deeper lighting cove 100*b* is created. In other words, a lighting module installed in the lighting cove 100*b* will be recessed farther above the suspended ceiling system than a lighting module installed in the lighting cove 100*a*. Accordingly, the length of the second vertical leg 106 may be varied to achieve a desired cove depth. For the remainder of this description, embodiments will be described with reference to lighting cove 100*a*, but it will be understood that the description applies equally to lighting cove 100*b*.

Figure 2:
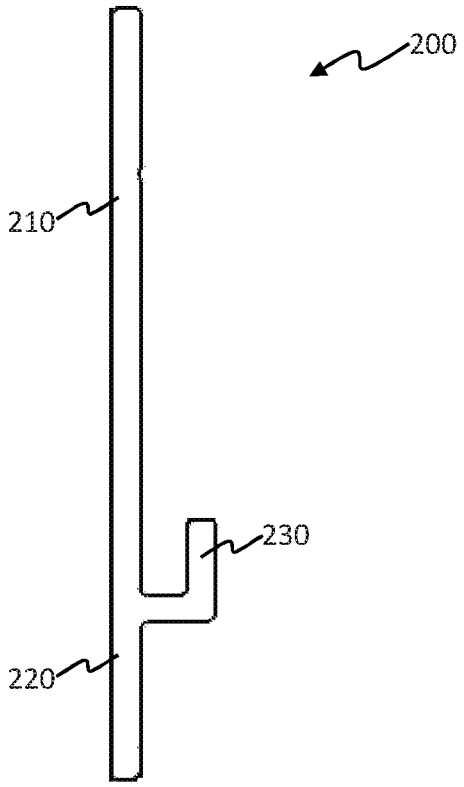
FIG. 2 is a side view of a wall hook, according to an embodiment of the invention.

The wall attachment portion 110 on the outside face of the first vertical leg 104 includes a downward facing hook 112 and a lower protuberance 114. The downward facing hook 112 is nearer the horizontal arm 102 than the lower protuberance 114. The lower protuberance 114 includes a horizontal prong 116 and a vertical prong 118 which extends toward the downward facing hook 112. As explained in greater detail below, the wall attachment portion 110 enables the lighting cove 100*a* to be attached to a structural wall 10 (FIG. 6) via a wall hook 200 (FIG. 2).

The light attachment portions 120, 120*a* on the inside faces of the first vertical leg 104 and the second vertical leg 106 each include a downward facing hook 122, an upward facing hook 124, and a shoulder 126. The downward facing hook 122 is nearest to the horizontal arm 102 and the shoulder 126 is farthest from the horizontal arm 102. The upward facing hook 124 is between the downward facing hook 122 and the shoulder 126. As explained in greater detail below, the light attachment portions 120, 120*a*, optionally in conjunction with hold down clips 400 (FIG. 4B), enables a lighting module 300 (FIG. 3) to be secured to the inside of the lighting cove 100*a*.

The hanger attachment portion 130 on the outside face of the second vertical leg 106 includes a downward facing hook 132 and a upward facing hook 134. The downward facing hook 132 is nearer the horizontal arm 102 than the upward facing hook 134. As explained in greater detail below, the hanger attachment portion 130 enables a hanging clip 500 (FIG. 5A) to be attached to the second vertical leg 106 which attaches to a hanger wire 600 (FIG. 9) to further support the lighting cove 100*a* from a structural support above the lighting cove 100*a*.

The ceiling grid attachment portion 140 on the outside face of the second vertical leg 106 includes a downward facing hook 142, an upward facing hook 144, and a ledge 146. The downward facing hook 142 is nearest to the horizontal arm 102 and the ledge 146 is farthest from the horizontal arm 102. The upward facing hook 144 is between the downward facing hook 142 and the ledge 146. As explained in greater detail below, the ceiling grid attachment portion 140 enables the lighting cove 100*a* to be attached to a ceiling beam 700 (FIG. 11) via a connector clip 750 (FIG. 12).

Figure 6:
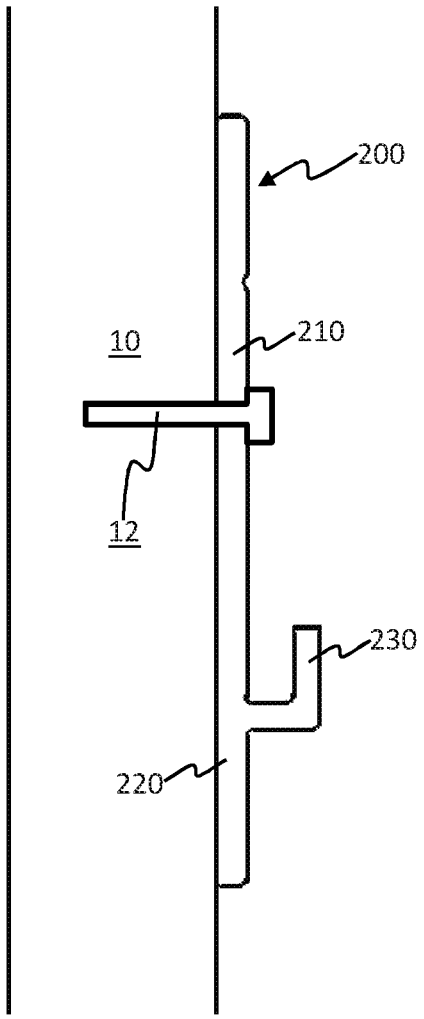
FIG. 6 is a side view of a wall hook mounted to a structural wall, according to an embodiment of the invention.

Referring to FIG. 2, a wall hook 200 is provided according to an embodiment of the invention. The wall hook 200 includes an upper vertical portion 210, a lower vertical portion 220, and a upward facing hook 230 which separates the upper vertical portion 210 and the lower vertical portion 220. As mentioned above and explained in greater detail below, the wall hook 200 attaches the lighting cove 100*a* to a structural wall 10 (FIG. 6).

Figure 3:
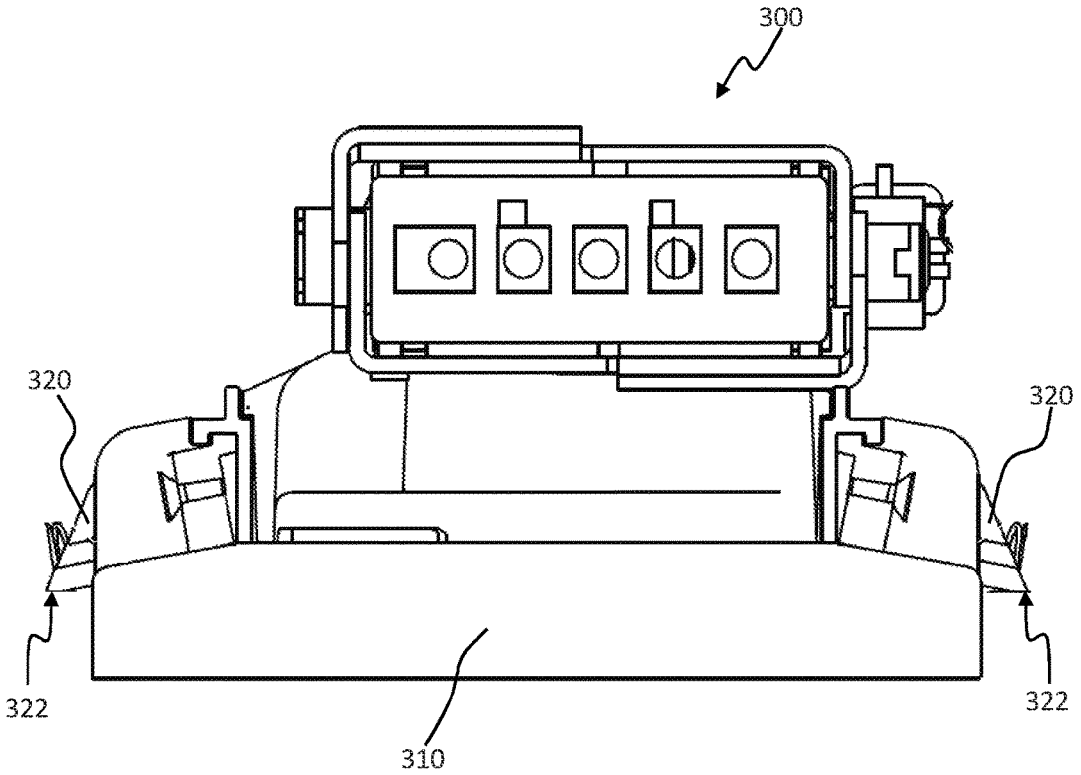
FIG. 3 is a side view of a lighting module, according to an embodiment of the invention.

Referring to FIG. 3, a lighting module 300 is provided according to an embodiment of the invention. The lighting module 300 includes a body 310 and retractable latches 320 on each side of the body 310. Each retractable latch 320 includes a downward facing point 322 which, when retracted, does not extend beyond the body 310. The retractable latches 320 are spring loaded so that a force is required to retract the retractable latches 320 into the body 310 and the retractable latches 320 extend back out once the force is removed. As mentioned above and explained in greater detail below, the lighting module 300 is secured inside the lighting cove 100*a* by the light attachment portions 120, 120*a*.

Figure 4A:
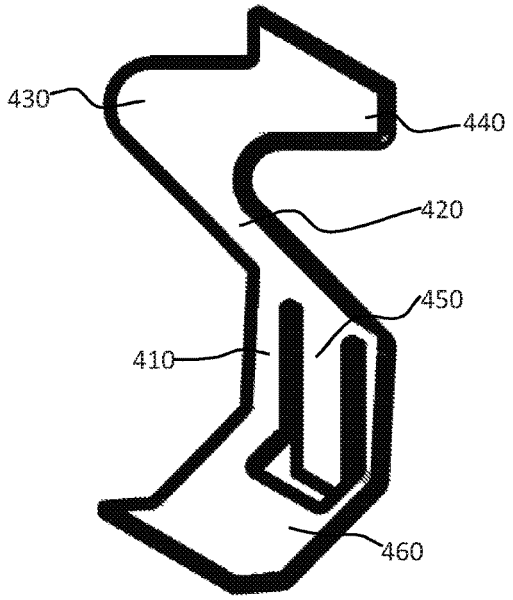
FIG. 4A is a perspective view of a hold down clip, according to an embodiment of the invention.
Figure 4B:
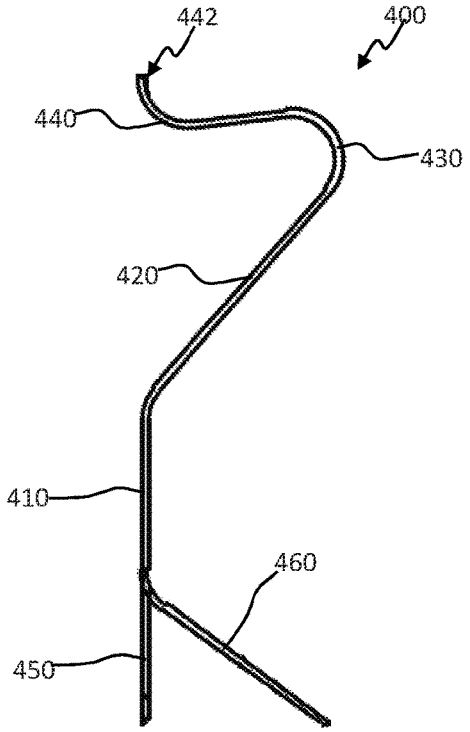
FIG. 4B is a side view of the hold down clip of FIG. 4A, according to an embodiment of the invention.

Referring to FIGS. 4A and 4B, a hold down clip 400 is provided according to an embodiment of the invention. FIGS. 4A and 4B are a perspective view and a side view, respectively, of the hold down clip 400. The hold down clip 400 includes a vertical portion 410, an upper angled portion 420, a first bend 430, a second bend 440, a vertical prong 450, and an angled prong 460. The hold down clip 400 is made of a flexible but resilient material so that the hold down clip 400 is able to be bent by a force but also applies an elastic force in response. The upper angled portion 420 and the angled prong 460 are attached to opposite ends of the vertical portion 410. The first bend 430 is attached to the upper angled portion 420 and bends back toward the vertical portion 410. The second bend 440 is attached to the first bend 430 and bends back away from the vertical portion 410. An end 442 of the second bend 440 should be approximately parallel to, and in line with, the vertical portion 410. The vertical prong 450 extends from the vertical portion 410. In the exemplary embodiment depicted in FIG. 4A, the vertical prong 450 is a cut-out center portion of the vertical portion 410. As mentioned above and explained in greater detail below, the hold down clip 400 helps secure the lighting module 300 inside the lighting cove 100*a*.

Figure 5A:
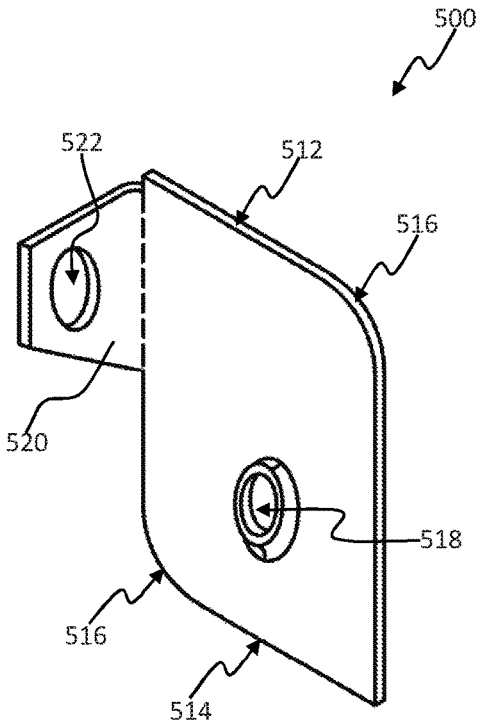
FIG. 5A is a perspective view of a hanging clip, according to an embodiment of the invention.
Figure 5B:
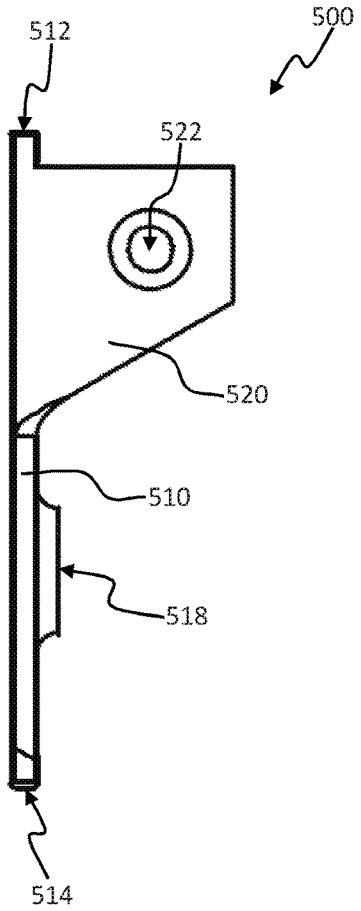
FIG. 5B is a side view of the hanging clip of FIG. 5A, according to an embodiment of the invention.

Referring to FIGS. 5A and 5B, a hanging clip 500 is provided according to an embodiment of the invention. FIGS. 5A and 5B are a perspective view and a side view, respectively, of the hanging clip 500. The hanging clip 500 includes a body 510, a top edge 512, a bottom edge 514, and a protrusion 520. Two opposite corners 516 of the body 510 are rounded. The body 510 includes a hole 518 and the protrusion 520 includes a hole 522. As mentioned above and explained in greater detail below, a hanger wire 600 (FIG. 9) attaches to the hanging clip 500 to further support the lighting cove 100*a* from a structural support above the lighting cove 100*a*.

FIGS. 6-12 demonstrate how the components described above are assembled to create a ceiling light cove as part of a suspended ceiling system. First, referring to FIG. 6, the wall hook 200 is attached to a structural wall 10 by one or more fasteners 12 (e.g., nails, screws, etc.) inserted through the upper vertical portion 210 of the wall hook 200 and into the structural wall 10. Additional fasteners (not shown) may also be inserted through the lower vertical portion 220 for additional support, but may not be required. The wall hook 200 is attached to the structural wall 10 at a height above the desired height of the suspended ceiling. The exact height above the desired height of the suspended ceiling will depend on the length of the second vertical leg 106 of the lighting cove 100*a*. A longer second vertical leg 106 requires the wall hook 200 to be attached to the structural wall 10 at a greater height above the desired height of the suspended ceiling.

Figure 7:
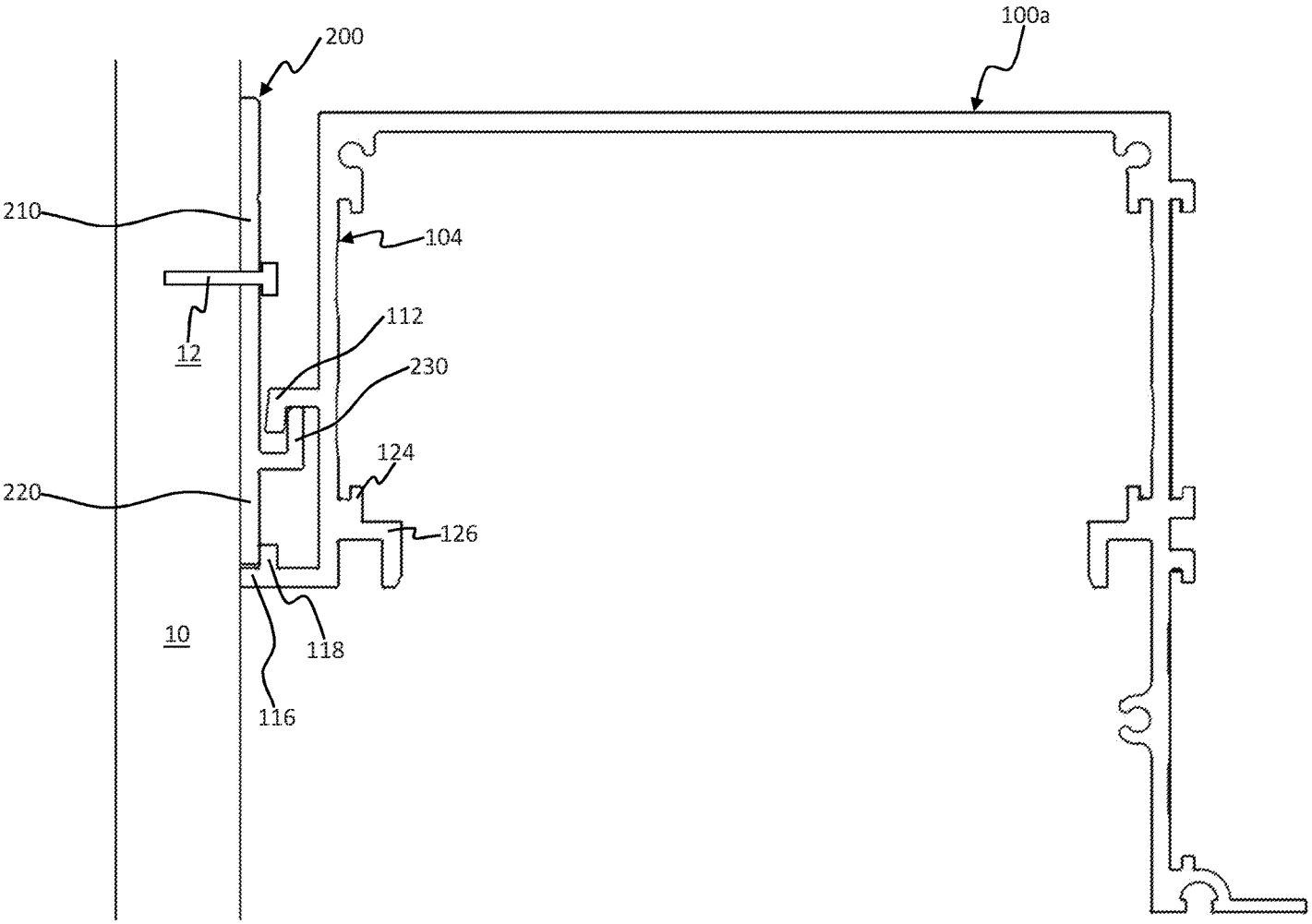
FIG. 7 is a side view of a lighting cove mounted to a wall hook, according to an embodiment of the invention, above the lighting cove.

Referring to FIG. 7, once the wall hook 200 is attached to the structural wall 10, the lighting cove 100*a* is attached to the wall hook 200 by placing the downward facing hook 112 of the lighting cove 100*a* over the upward facing hook 230 of the wall hook 200 and then rotating the lighting cove 100*a* until the horizontal prong 116 of the lighting cove 100*a* contacts the structural wall 10. Once in position, both the horizontal prong 116 and the vertical prong 118 are in contact with the lower vertical portion 220 of the wall hook 200. The lower vertical portion 220 and the horizontal prong 116 prevent the lighting cove 100*a* from moving up, the downward facing hook 112 and the upward facing hook 230 prevent the lighting cove 100*a* from moving down or moving right (i.e., away from the structural wall 10), the lower vertical portion 220 and the vertical prong 118 prevent the lighting cove 100*a* from moving left (i.e., toward the structural wall 10). Therefore, the lighting cove 100*a* may be attached to the wall hook 200 without requiring the use of fasteners. As described in more detail below, the lighting cove 100*a* may be further secured in position by a hanger wire 600 (FIG. 9) and by the suspended ceiling attached to the second vertical leg 106 of the lighting cove 100*a*.

Figure 8:
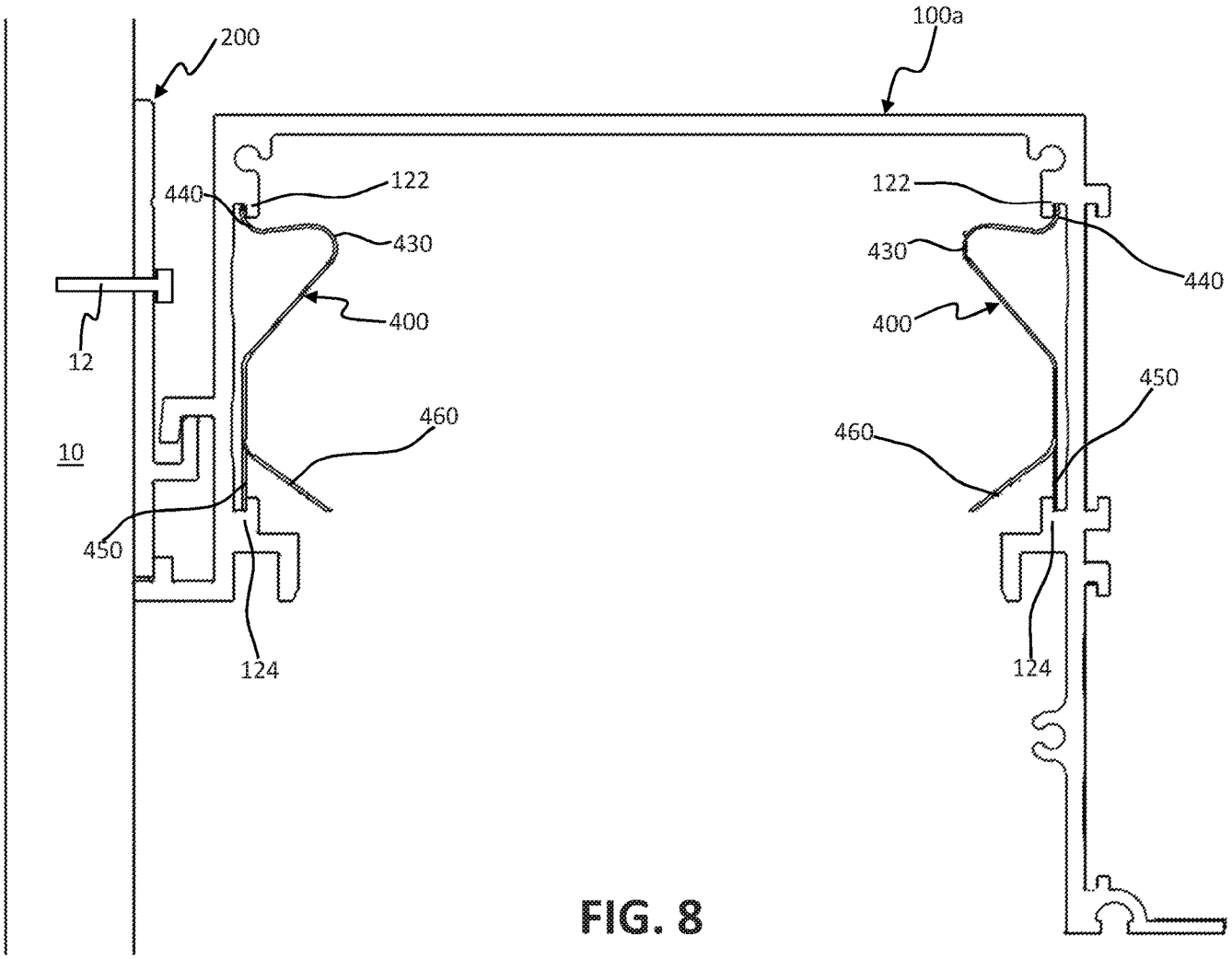
FIG. 8 is a side view of hold down clips mounted to a lighting cove, according to an embodiment of the invention.

Referring to FIG. 8, hold down clips 400 are installed on each of the first vertical leg 104 and the second vertical leg 106 by inserting the end 442 of the second bend 440 into the downward facing hook 122 of each of the first vertical leg 104 and the second vertical leg 106, pressing up to compress the first bend 430, and inserting the vertical prong 450 into the upward facing hook 124. Once the vertical prong 450 is inserted into the upward facing hook 124, the hold down clip 400 may be released and the elastic force caused by the first bend 430 expanding will hold the hold down clip 400 in place. Each hold down clip 400 is installed with the angled prongs 460 pointing inward (i.e., toward the opposing first vertical leg 104 or the opposing second vertical leg 106). Although the hold down clips 400 are shown installed with the lighting cove 100*a* attached to the wall hook 200, the hold down clips 400 may be installed at any time prior to the installation of the lighting module 300, for example before or after the lighting cove 100*a* is attached to the wall hook 200 and before or after the hanging clip 500 is attached to the lighting cove 100*a*. Typically, it will be easiest to install the hold down clips 400 prior to attaching the lighting cove 100*a* to the wall hook 200.

Figure 9:
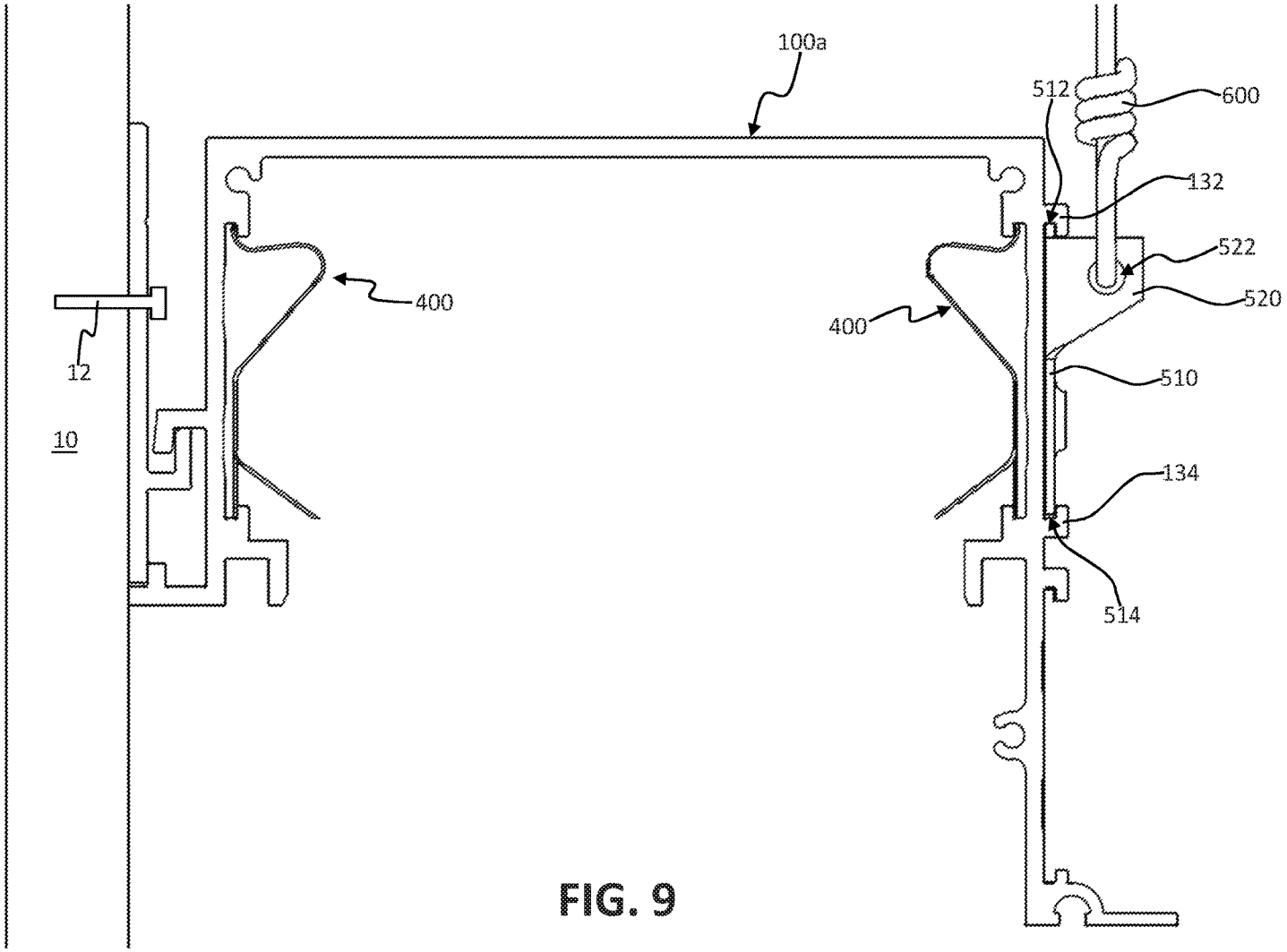
FIG. 9 is a side view of a hanging clip mounted to a lighting cove, according to an embodiment of the invention.

Referring to FIG. 9, after the lighting cove 100*a* is attached to the wall hook 200, the lighting cove 100*a* may be further secured by a hanger wire 600. To install the hanger wire 600, the hanging clip 500 is first attached to the lighting cove 100*a* by inserting the top edge 512 of the hanging clip 500 into the downward facing hook 132 of the lighting cove 100*a* and inserting the bottom edge 514 of the hanging clip 500 into the upward facing hook 134 of the lighting cove 100*a*. The hanging clip 500 may be installed by first aligning the rounded corners 516 between the downward facing hook 132 and the upward facing hook 134, and then rotating the hanging clip 500 into position. One end of the hanger wire 600 may then be inserted through the hole 522 in the protrusion 520 and tied, with the other end (not shown) of the hanger wire 600 secured to structure above the lighting cove 100*a*.

Figure 10:
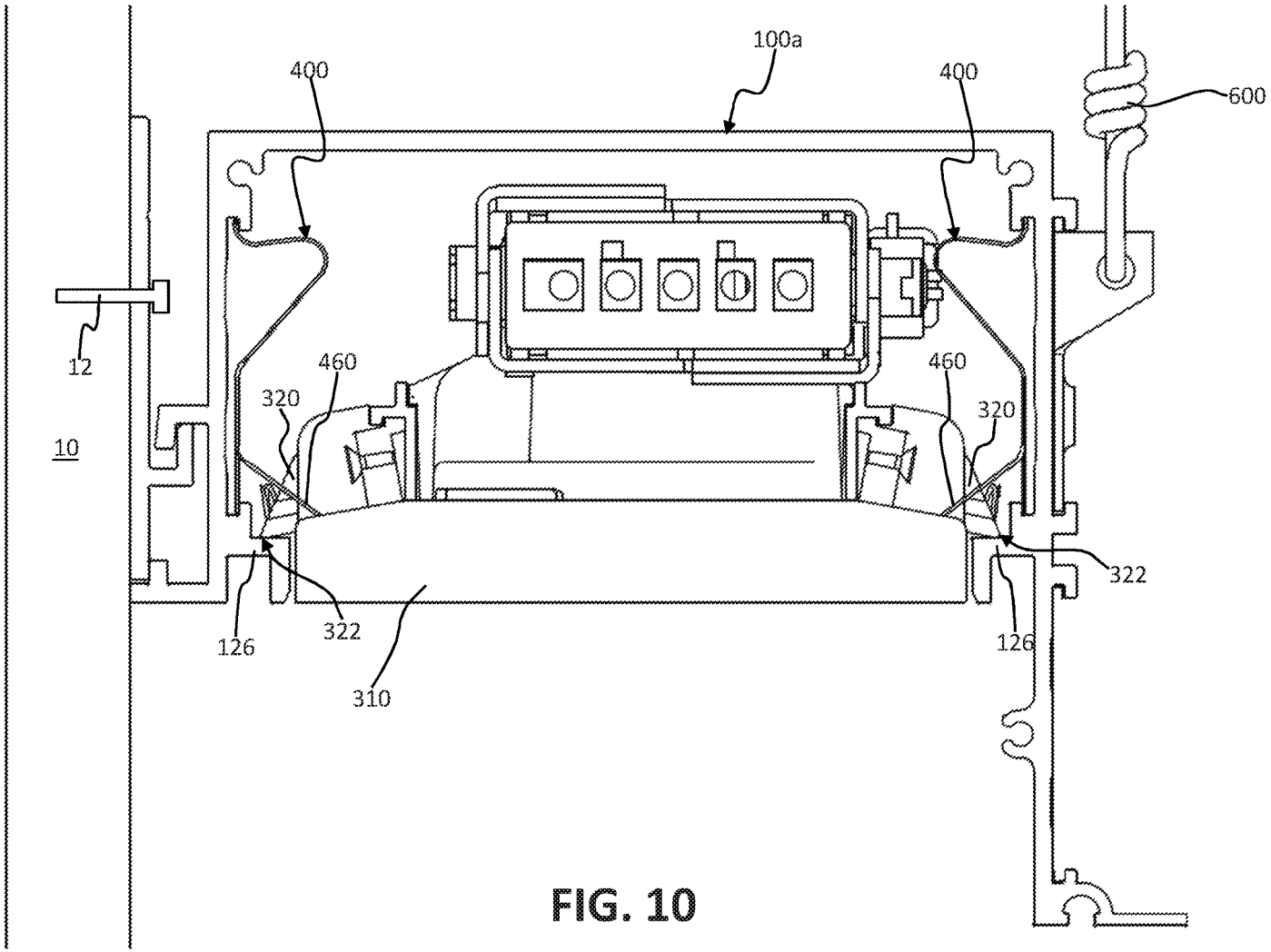
FIG. 10 is a side view of a lighting module mounted in a lighting cove, according to an embodiment of the invention.

Referring to FIG. 10, the lighting module 300 is installed into the lighting cove 100*a* by inserting the lighting module 300 into the lighting cove 100*a* with the downward facing points 322 of the retractable latches 320 facing away from the horizontal arm 102. When the retractable latches 320 contact the shoulders 126 of the lighting cove 100*a*, the retractable latches 320 will be pressed into the body 310 of the lighting module 300, allowing the lighting module 300 to pass the shoulders 126. Once the retractable latches 320 are past the shoulders 126, the retractable latches 320 will extend and prevent the lighting module 300 from being removed from the lighting cove 100*a*. Once installed, the lighting module 300 will contact the angled prongs 460 of the hold down clips 400, which apply a downward force to the lighting module 300. Accordingly, downward movement of the lighting module 300 is prevented by the shoulders 126 and the retractable latches 320, and upward movement of the lighting module 300 is prevented by the hold down clips 400, and the lighting module 300 is secured in place.

Although in FIG. 8 the lighting module 300 is shown installed after the lighting cove 100*a* is attached to the wall hook 200 and the hanging clip 500 and the hanger wire 600 are installed, it will be understood that the lighting module 300 may be installed at any time during installation of the suspended ceiling. The lighting module 300 may also be removed by inserting a tool into the lighting cove 100*a* and applying pressure to the retractable latches 320 to cause the retractable latches 320 to retract back into the body 310. The lighting module 300 may then be reinserted later, for example after cleaning, or replaced. Typically, the lighting module 300 will be installed after the lighting cove 100*a* is attached to the wall hook 200 and the hanging clip 500 is installed. It will further be understood that in some applications, the hanging clip 500, the hold down clips 400, or both may be omitted if the additional stability is not required.

Figure 11:
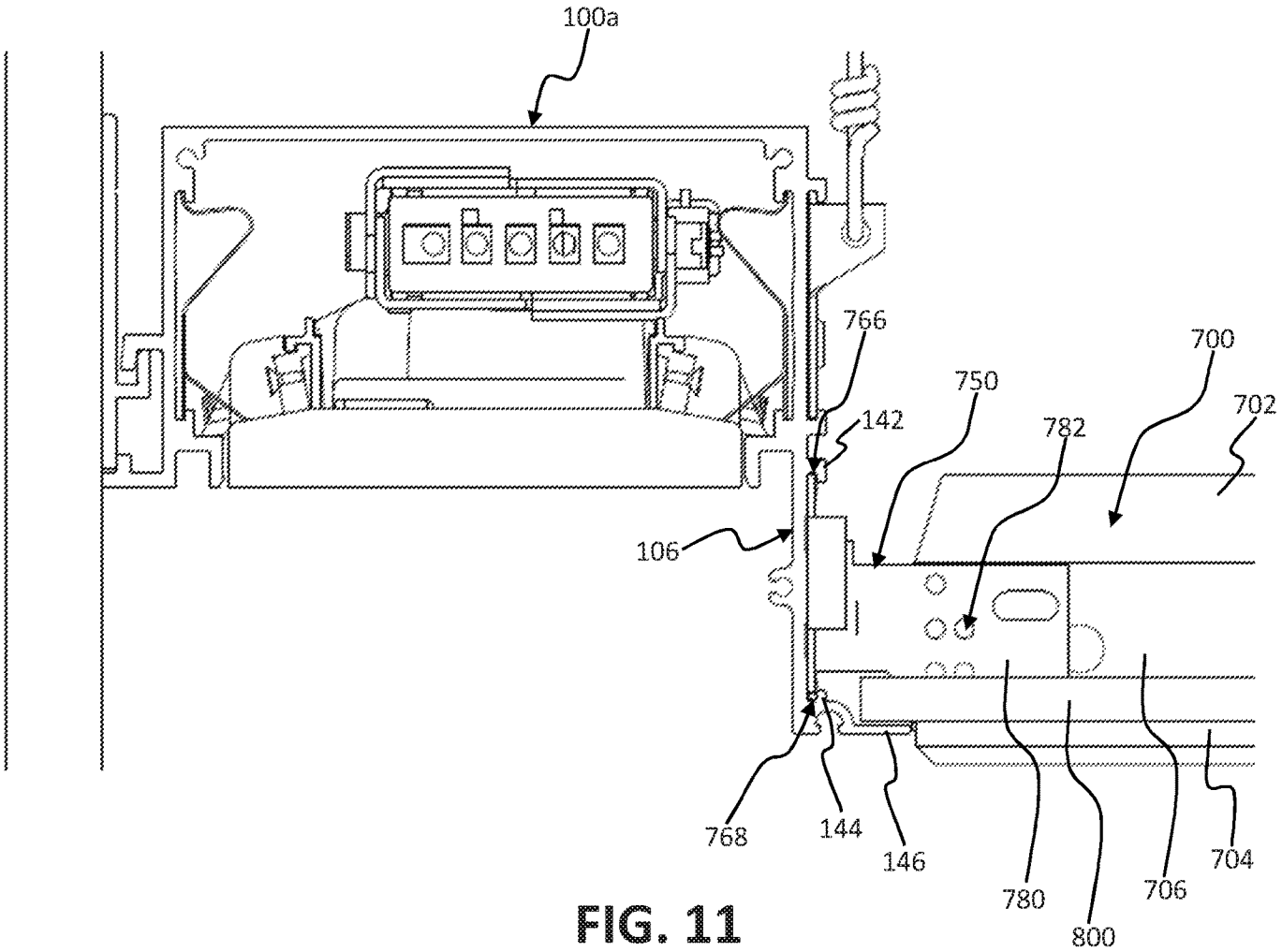
FIG. 11 is a side view of a ceiling beam attached to a lighting cove, according to an embodiment of the invention.
Figure 12:
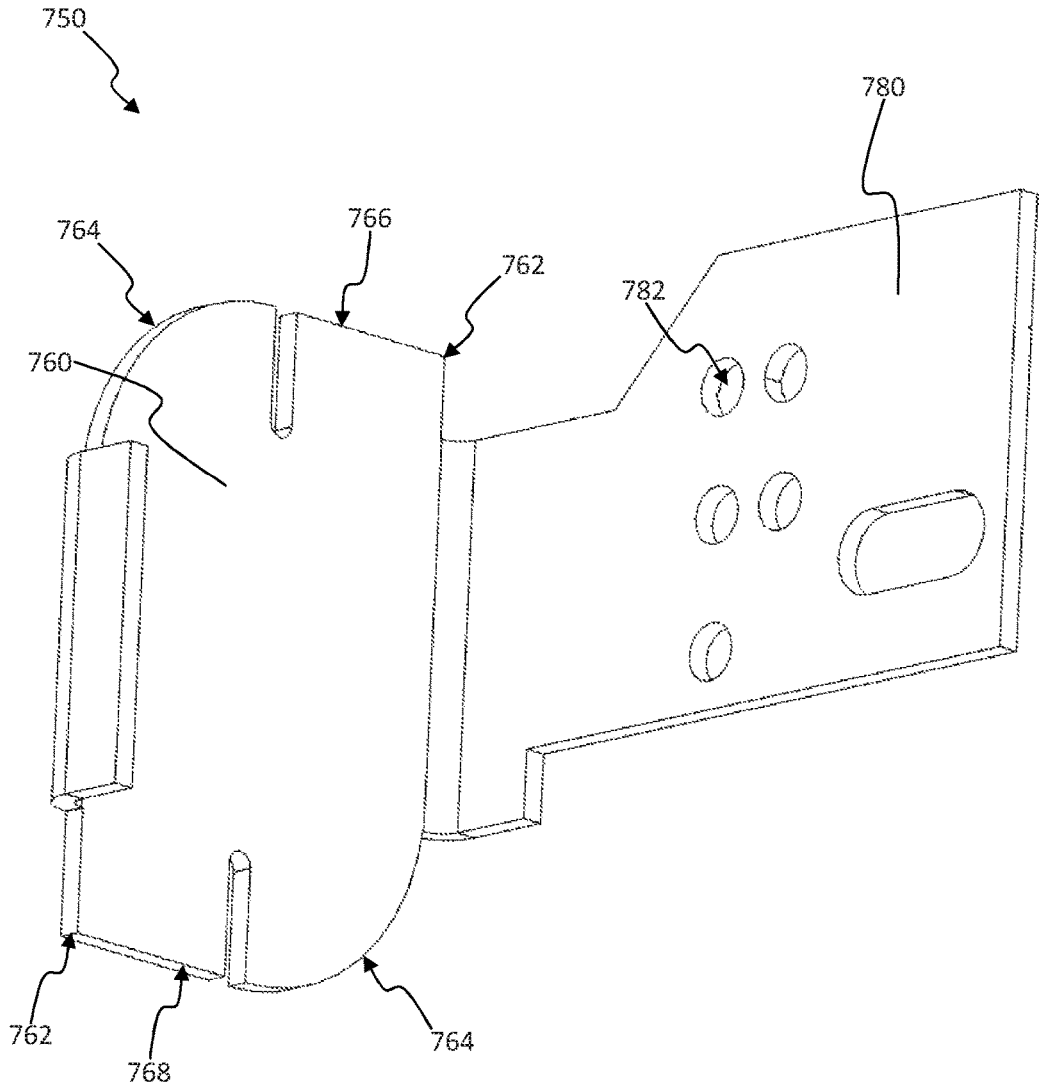
FIG. 12 is a profile view of a connector clip, according to an embodiment of the invention.

Referring to FIGS. 11-12, a ceiling beam 700 may be attached to the lighting cove 100*a* using a connector clip 750. FIG. 11 is a side view of the ceiling beam 700 attached to the lighting cove 100*a*. FIG. 12 is a perspective view of only the connector clip 750. The connector clip 750 includes a channel portion 760 and a beam portion 780 joined at a right angle to the channel portion 760. The channel portion 760 is generally rectangular in cross section, includes two square corners 762 on diagonally opposing corners and two rounded corners 764 on the remaining two diagonally opposing corners, and has a substantially flat top surface 766 and a substantially flat bottom surface 768. The beam portion 780 includes a plurality of holes 782.

The connector clip 750 is attached to the lighting cove 100*a* by first vertically aligning the two rounded corners 764 between the downward facing hook 142 and the upward facing hook 144 of the lighting cove 100*a*. The connector clip 750 is then rotated to vertically align the top surface 766 and the bottom surface 768 so that the top surface 766 and the bottom surface 768 engage with the upward facing hook 144 and the downward facing hook 142. The ceiling beam 700 may then be secured to the connector clip 750. The ceiling beam 700 includes, in cross section, a bulb 702 at the top, a vertical downward extending web 704, and horizontally extending flanges 706 at the bottom of the web 704. The ceiling beam 700 is attached to the connector clip 750 by securing one or more fastening elements, such as screws, though the holes 782 in the beam portion 780 of the connector clip 750 and into the web 704 of the ceiling beam 700. In some embodiments, the flanges 706 of the ceiling beam 700 may rest on the ledge 146 of the lighting cove 100*a* for extra support.

After the ceiling beam 700 is installed, a ceiling panel 800 may be installed, for example by resting the ceiling panel 800 on the flanges 706 of the ceiling beam 700. It will be understood that many variations on the design of the ceiling beam 700, the connector clip 750, and the ceiling panel 800 are possible. For example, rather than a ceiling panel 800 resting on the flanges 706 of the ceiling beam 700, drywall may be attached to the bottom of the flanges 706. Other ceiling panels 800 may slot over the flanges 706 instead of resting on the flanges 706. It will further be understood that the ceiling beam 700 may be installed prior to the lighting module 300 being installed in the lighting cove 100*a*.

Figure 13:
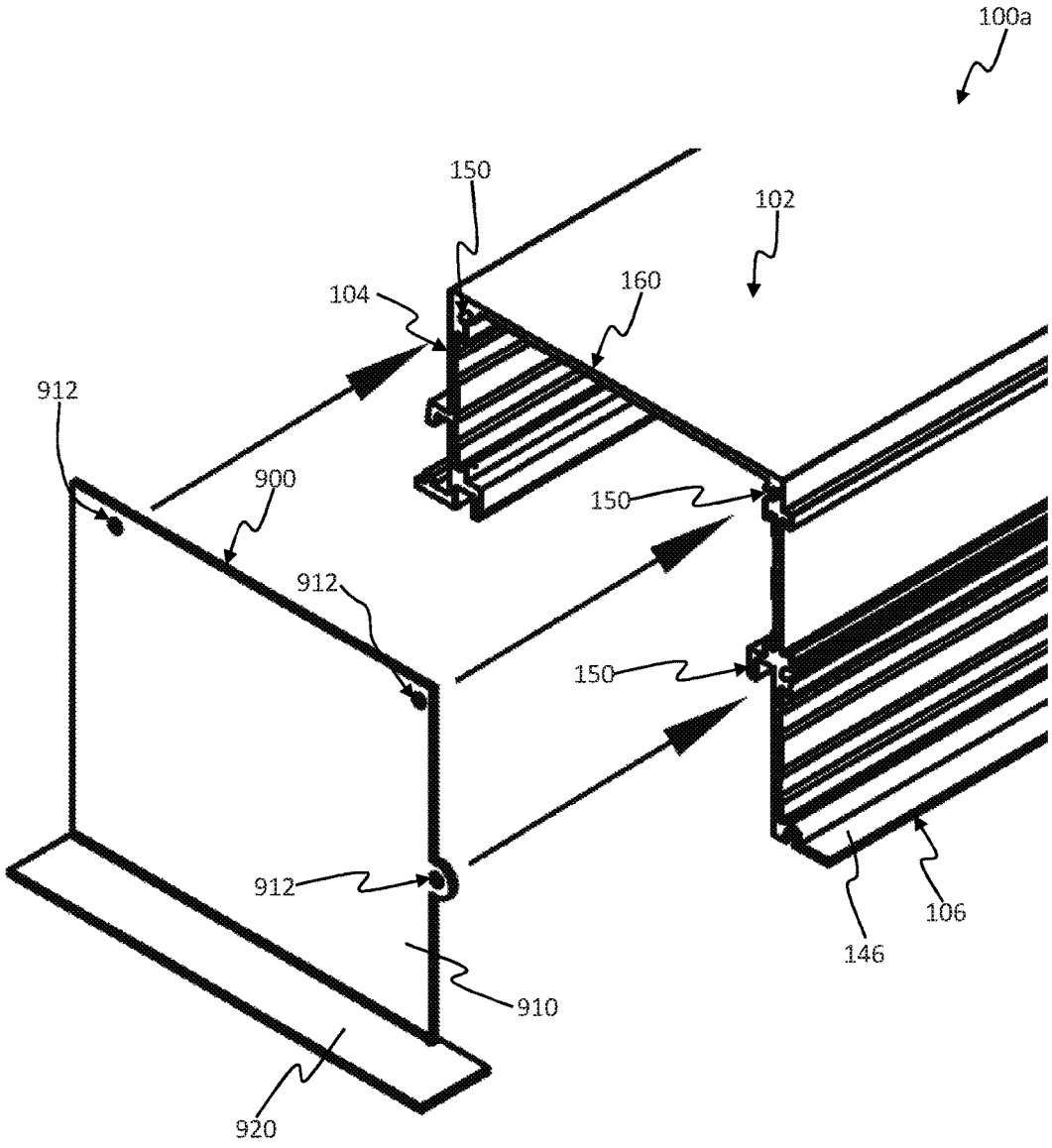
FIG. 13 is a profile view of an end cap attached to a lighting cove, according to an embodiment of the invention.

Referring to FIG. 13, in embodiments where the lighting cove 100*a* does not extend fully to another wall, it may be desirable to enclose an end 160 of the lighting cove 100*a* with an end cap 900. The end cap 900 includes a body portion 910 and a ledge portion 920 attached to the body portion 910 at a right angle. The body portion 910 includes a plurality of holes 912 which align with the screw holes 150 of the lighting cove 100*a*. The end cap 900 is attached to the lighting cove 100*a* using a plurality of fasteners (e.g., screws) which are inserted through the plurality of holes 912 in the end cap 900 and the screw holes 150 of the lighting cove 100*a*. Once attached, the ledge portion 920 is aligned with the ledge 146 of the lighting cove 100*a*.

The invention is not limited to the embodiments described and exemplified above, but is capable of variation and modification within the scope of the appended claims.

We claim:

1. A lighting cove apparatus comprising:

a lighting cove including:

a horizontal arm, a first vertical leg attached to a first end of the horizontal arm, a second vertical leg attached to a second end of the horizontal arm, and a downward facing hook and an upward facing hook on each of the inside faces of the first vertical leg and the second vertical leg, wherein, the first vertical leg and the second vertical leg each include a shoulder on an inside face, the downward facing hooks are nearest to the horizontal arm, the shoulders are farthest from the horizontal arm, and the upward facing hooks are between the downward facing hooks and the shoulders;

a lighting module including a body and a plurality of retractable latches having downward facing points which retract into the body; and hold down clips having ends inserted into the downward facing hooks on each of the first vertical leg and the second vertical leg, vertical prongs inserted into the upward facing hooks on each of the first vertical leg and the second vertical leg, and downward facing angled prongs, wherein the downward facing angled prongs apply a downward force to the lighting module, and when the lighting module is inserted into the lighting cove between the first vertical leg and the second vertical leg, the shoulders on the first vertical leg and the second vertical leg press on the retractable latches such that the retractable latches retract and the lighting module can pass the shoulders, and wherein when the lighting module passes the shoulders the retractable latches re-extend and prevent the lighting module from being removed from the lighting cove.

2. A lighting cove apparatus comprising:

a lighting cove including:

a horizontal arm, a first vertical leg attached to a first end of the horizontal arm, a second vertical leg attached to a second end of the horizontal arm, and a downward facing hook and an upward facing hook on an outside face of the second vertical leg wherein, the first vertical leg and the second vertical leg each include a shoulder on an inside face;

a lighting module including a body and a plurality of retractable latches having downward facing points which retract into the body; and a hanging clip having a body and a protrusion attached to the body, the body having a top edge contacting the downward facing hook on the outside face of the second vertical leg and a bottom edge contacting the upward facing hook on the outside face of the second vertical leg, and the protrusion having a hole.

3. The apparatus of claim 2, wherein the apparatus further includes a hanger wire having a first end inserted through the hole in the protrusion and a second end adapted to be secured to a structure above the lighting cove.

4. A lighting cove apparatus comprising:

a lighting cove including:

a horizontal arm, a first vertical leg attached to a first end of the horizontal arm, a second vertical leg attached to a second end of the horizontal arm, and a downward facing hook and an upward facing hook on an outside face of the second vertical leg wherein, the first vertical leg and the second vertical leg each include a shoulder on an inside face;

a lighting module including a body and a plurality of retractable latches having downward facing points which retract into the body; and a connector clip having a channel portion and a beam portion attached to the channel portion, the channel portion having a top edge contacting the downward facing hook on the outside face of the second vertical leg and a bottom edge contacting the upward facing hook on the outside face of the second vertical leg, and the beam portion adapted to be attached to a web of a ceiling beam.

5. A lighting cove apparatus comprising:

a lighting cove including a horizontal arm, a first vertical leg attached to a first end of the horizontal arm, a second vertical leg attached to the horizontal arm, wherein the first vertical leg includes a downward facing hook and a lower protuberance on an outside face of the first vertical leg, the downward facing hook nearer the horizontal arm than the lower protuberance, the lower protuberance including a horizontal prong and a vertical prong; and a wall hook having a upper vertical portion, a lower vertical portion, and an upward facing hook which separates the upper vertical portion and the lower vertical portion, wherein the downward facing hook on the outside face of the first vertical leg of the lighting cove rests on the upward facing hook of the wall hook, and the horizontal prong and the vertical prong are both in contact with an end of the lower vertical portion of the wall hook.

6. The apparatus of claim 5, wherein the wall hook is adapted to be attached to a structural wall.

7. The apparatus of claim 5, wherein:

the lighting cove further includes shoulders on inside faces of the first vertical leg and the second vertical leg; and the apparatus further comprises a lighting module having a body and a plurality of retractable latches having downward facing points which retract into the body, wherein when the lighting module is inserted into the lighting cove between the first vertical leg and the second vertical leg, the shoulders on the first vertical leg and the second vertical leg press on the retractable latches such that the retractable latches retract and the lighting module can pass the shoulders, and wherein when the lighting module passes the shoulders the retractable latches re-extend and prevent the lighting module from being removed from the lighting cove.

8. The apparatus of claim 7, wherein:

the lighting cove further includes a downward facing hook and an upward facing hook on each of the inside faces of the first vertical leg and the second vertical leg, wherein the downward facing hooks are nearest to the horizontal arm, the shoulders are farthest from the horizontal arm, and the upward facing hooks are between the downward facing hooks and the shoulders; and the apparatus further includes hold down clips having ends inserted into the downward facing hooks on each of the first vertical leg and the second vertical leg, vertical prongs inserted into the upward facing hooks on each of the first vertical leg and the second vertical leg, and downward facing angled prongs, wherein the downward facing angled prongs apply a downward force on the lighting module.

9. The apparatus of claim 5, wherein:

the lighting cove further includes a downward facing hook and an upward facing hook on an outside face of the second vertical leg; and the apparatus further includes a hanging clip having a body and a protrusion attached to the body, the body having a top edge contacting the downward facing hook on the outside face of the second vertical leg and a bottom edge contacting the upward facing hook on the outside face of the second vertical leg, and the protrusion having a hole.

10. The apparatus of claim 9, wherein the apparatus further includes a hanger wire having a first end inserted through the hole in the protrusion and a second end adapted to be secured to a structure above the lighting cove.

11. The apparatus of claim 5, wherein:

the lighting cove further includes a downward facing hook and an upward facing hook on an outside face of the second vertical leg; and the apparatus further including a connector clip having a channel portion and a beam portion attached to the channel portion, the channel portion having a top edge contacting the downward facing hook on the outside face of the second vertical leg and a bottom edge contacting the upward facing hook on the outside face of the second vertical leg, and the beam portion adapted to be attached to a web of a ceiling beam.

12. A lighting cove apparatus comprising:

a lighting cove including:

a horizontal arm, a first vertical leg attached to a first end of the horizontal arm, a second vertical leg attached to a second end of the horizontal arm, a wall attachment portion on an outside face of the first vertical leg having a downward facing hook and a lower protuberance, the downward facing hook nearer the horizontal arm than the lower protuberance, the lower protuberance including a horizontal prong and a vertical prong, a first light attachment portion on an inside face of the first vertical leg having a shoulder, a second light attachment portion on an inside face of the second vertical leg having a shoulder, and a hanger attachment portion on an outside face of the second vertical leg having a downward facing hook and an upward facing hook;

a wall hook including a upper vertical portion, a lower vertical portion, and an upward facing hook which separates the upper vertical portion and the lower vertical portion, wherein the downward facing hook of the wall attachment portion of the lighting cove rests on the upward facing hook of the wall hook, and the horizontal prong and the vertical prong of the wall attachment portion of the lighting cove are both in contact with an end of the lower vertical portion of the wall hook;

a lighting module including a body and a plurality of retractable latches having downward facing points which retract into the body, wherein when the lighting module is inserted into the lighting cove between the first vertical leg and the second vertical leg, the shoulders on the first vertical leg and the second vertical leg press on the retractable latches such that the retractable latches retract and the lighting module can pass the shoulders, and when the lighting module passes the shoulders the retractable latches re-extend and prevent the lighting module from being removed from the lighting cove;

a hanging clip including a body and a protrusion attached to the body, the body having a top edge contacting the downward facing hook of the hanger attachment portion of the lighting cove and a bottom edge contacting the upward facing hook of the hanger attachment portion of the lighting cove, and the protrusion having a hole; and a hanger wire having a first end inserted through the hole in the protrusion of the hanging clip and a second end adapted to be secured to a structure above the lighting cove.

13. The apparatus of claim 12, wherein the wall hook is adapted to be attached to a structural wall.

14. The apparatus of claim 12, wherein:

the first light attachment portion further has a downward facing hook and an upward facing hook, the downward facing hook nearest to the horizontal arm, the shoulder farthest from the horizontal arm, and the upward facing hook between the downward facing hook and the shoulder, the second light attachment portion further has a downward facing hook and an upward facing hook, the downward facing hook nearest to the horizontal arm, the shoulder farthest from the horizontal arm, and the upward facing hook between the downward facing hook and the shoulder, and the apparatus further includes hold down clips having ends inserted into the downward facing hooks of the first light attachment portion and the second light attachment portion, vertical prongs inserted into the upward facing hooks of the first light attachment portion and the second light attachment portion, and downward facing angled prongs, wherein the downward facing angled prongs of the hold down clips apply a downward force on the lighting module.

15. The apparatus of claim 12, wherein the lighting cove further includes a ceiling grid attachment portion below the hanger attachment portion, the ceiling grid attachment portion including a downward facing hook and an upward facing hook.

16. The apparatus of claim 15, wherein the apparatus further includes a connector clip having a channel portion and a beam portion attached to the channel portion, the channel portion having a top edge contacting the downward facing hook of the ceiling grid attachment portion and a bottom edge contacting the upward facing hook of the ceiling grid attachment portion, and the beam portion adapted to be attached to a web of a ceiling beam.

17. The apparatus of claim 12, further comprising an end cap attached to an end of the lighting cove.

* * * * *